US005358416A

United States Patent [19]

Power

[11] Patent Number: 5,358,416

[45] Date of Patent: Oct. 25, 1994

[54] ELECTRIC CONNECTOR

[75] Inventor: Michael Power, Shizuoka, Japan

[73] Assignee: Yazaki Corporation, Japan

[21] Appl. No.: 155,803

[22] Filed: Nov. 23, 1993

[30] Foreign Application Priority Data

Nov. 24, 1992 [JP] Japan ..... 4-313448

[51] Int. Cl.[5] ..... H01R 13/62

[52] U.S. Cl. ..... 439/157; 439/372

[58] Field of Search ..... 439/153, 157, 159, 372

[56] References Cited

U.S. PATENT DOCUMENTS 5,135,410 8/1992 Kawase et al. ..... 439/372

FOREIGN PATENT DOCUMENTS 52-40992 3/1977 Japan .
53-28891 3/1978 Japan .
54-20387 2/1979 Japan .
64-51276 3/1989 Japan .
564675 8/1977 U.S.S.R. ..... 439/372
2071928A 9/1981 United Kingdom ..... 439/372

*Primary Examiner*—Kurt C. Rowan
*Assistant Examiner*—Jeffrey T. Knapp
*Attorney, Agent, or Firm*—Venable, Baetjer, Howard & Civiletti

[57] ABSTRACT

An electric connector has a male connector housing and a female connector housing. The male connector housing is provided with slits substantially parallel with the engagement direction and cam plates respectively rotatable in the slits and integrally connected by a connecting member having a handle portion. The female connector housing is provided with an insertion guide wall extended from the bottom wall toward the mating face of the male connector housing, and vertical members erected at positions at the edge of the insertion guide wall corresponding to the slits. The small force to rotate the cam through a predetermined angle is converted into the pressure of the cam on the vertical members, and the male connector housing is pushed to the regular engagement position by reaction against the pressure.

7 Claims, 5 Drawing Sheets

ELECTRIC CONNECTOR

BACKGROUND OF THE INVENTION

1. Field of the Invention

The present invention relates to an electric connector, and particularly to an electric connector which can completely insert a male connector housing into a female connector housing provided with many plugs and sockets, respectively, by simply rotating a cam mounted on one of the connector housings with small force to secure complete electrical contact therebetween.

2. Description of the Prior Art

Since insertion frictional force increases as the number of plugs and the number of corresponding sockets of an electric connector increases, the force required for connecting and disconnecting a male connector housing and a female connector housing also increases. Japanese Utility Model Laid-Open No. 52-40992 (1977) discloses an electric connector in which the force required for connecting and disconnecting both connector housings is decreased. In this electric connector, a lever and a link connected thereto are provided on the outer periphery of a male connector housing so that a pin at an end of the link is inserted into a pin receiving portion provided on the-outer periphery of a female connector housing. When the lever is rotated, the male connector housing is moved to be forced into the female connector housing by the principle of the lever to achieve complete electric contact therebetween. When the lever is rotated in the reverse direction, the male connector housing is moved to be separated from the female connector housing, and the male connector housing can easily be drawn out therefrom.

However, such an electric connector has the disadvantages that it has a complicated shape in which the lever projects outwardly from the connector housings, and that since the length of the lever cannot be sufficiently increased, the force to operate the lever cannot be sufficiently decreased. The electric connector also has the danger that when the lever strikes on a substance, the link pin is separated from the pin receiving portion, and the connection between the male and female connector housings is made incomplete, thereby deteriorating electric contact therebetween.

SUMMARY OF THE INVENTION

In consideration of the above problems, it is an objective of the present invention to provide an electric connector which permits complete engagement, and which can securely hold the engagement state.

In order to achieve the objective, an electric connector of the present invention comprises a male connector housing and a female connector housing both of which are engaged with each other. The male connector housing of the electric connector comprises a plurality of slits formed in substantially parallel to the engagement direction, a cam shaft passed laterally through the male connector housing while crossing the slits, and a plurality of cam plates which are supported by the cam shaft so as to be respectively rotatable within the slits, which are connected by a lateral connecting member having a handle portion, and which are formed integrally with the connecting member. The female connector housing comprises an insertion guide wall extended from one of the bottom walls toward the mating face of the male connector housing, and a plurality of vertical members which are erected at positions at the edge portion of the insertion guide wall corresponding to a plurality of slits of the male connector housing. When the vertical members are respectively inserted into the slits, and when the cam plates are rotated through a predetermined angle, the cam plates respectively push the vertical members so that the male connector housing is moved to be inserted into the female connector housing.

Each of the cam plates preferably has a shape in which one or two projections are formed on the side opposite to the handle portion with regard to the cam shaft.

The electric connector of the present invention causes the male connector housing to be inserted to a complete insertion position in the female connector housing by the reaction against the force of the cam plates to push the vertical members when the male connector housing is placed on the insertion guide wall of the female connector housing so that the vertical members are respectively inserted into the slits of the male connector housing, and when the handle portion of the cam plate connecting member is rotated toward the female connector housing for a predetermined angle. The relatively small operating force uniformly through a predetermined angle and .simultaneously applied to the plurality of the cam plates is converted into large insertion force to insert the male connector housing to the regular insertion position, thereby holding positive electrical contact between the male and female connector housings.

Since the slits are provided in the male connector housing so that the cam plates can be rotated therein, the cam hardly projects from the outer periphery of the connector housing, and there is thus less danger that the cam strikes on a substance and separate both connector housings.

When the male connector housing is separated from the female connector housing, the cam may be rotated in the direction opposite to that of insertion.

Objectives, advantages and novel characteristics of the present invention are described in detail below with reference to the accompanying drawings.

DESCRIPTION OF THE PREFERRED EMBODIMENTS

Figure 1:
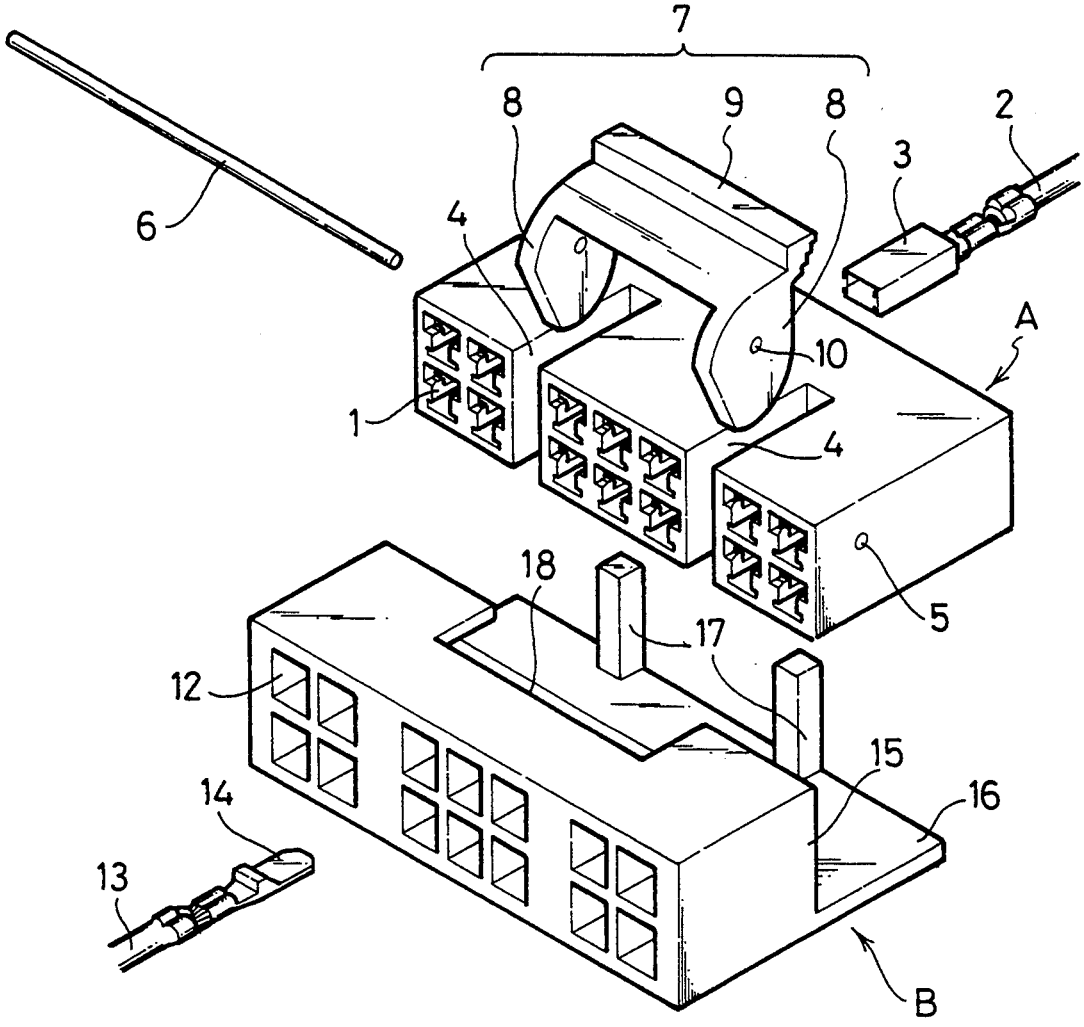
FIG. 1 is an exploded perspective view illustrating an electric connector in accordance with an embodiment of the present invention.

An electric connector according to an embodiment of the present invention comprises a male connector housing A and a female connector housing B, as shown in FIG. 1. The male connector housing A has a plurality of terminal chambers 1 into each of which a female terminal 3 connected to an electric wire 2 is inserted and locked. The male connector housing A also has two slits 4 which are formed on the side inserted into the female connector housing B so as to be substantially parallel to the engagement direction. A hole 5 laterally passing through the male connector housing A is provided therein, a cam shaft 6 being inserted into the hole so as to cross the slits 4.

Figure 2:
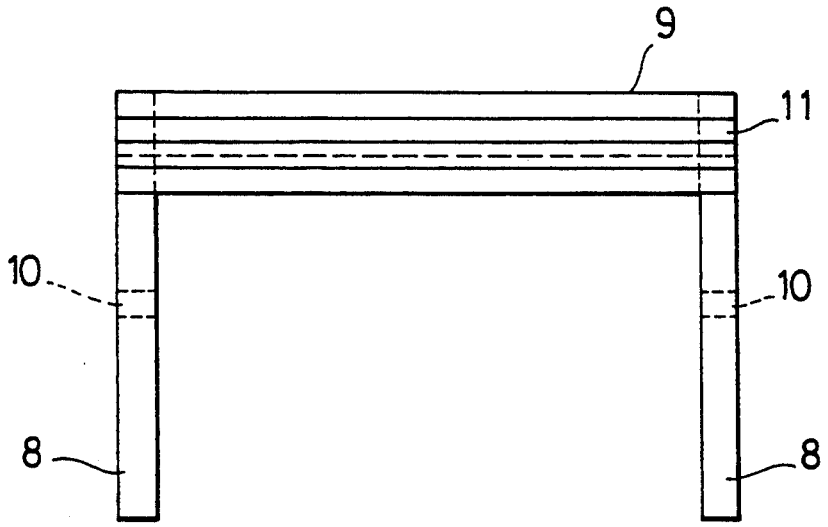
FIG. 2 is a front view of a cam.
Figure 3:
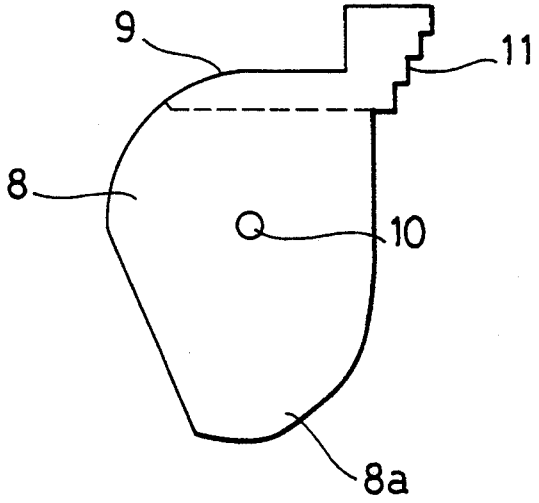
FIG. 3 is a side view of a cam.
Figure 4:
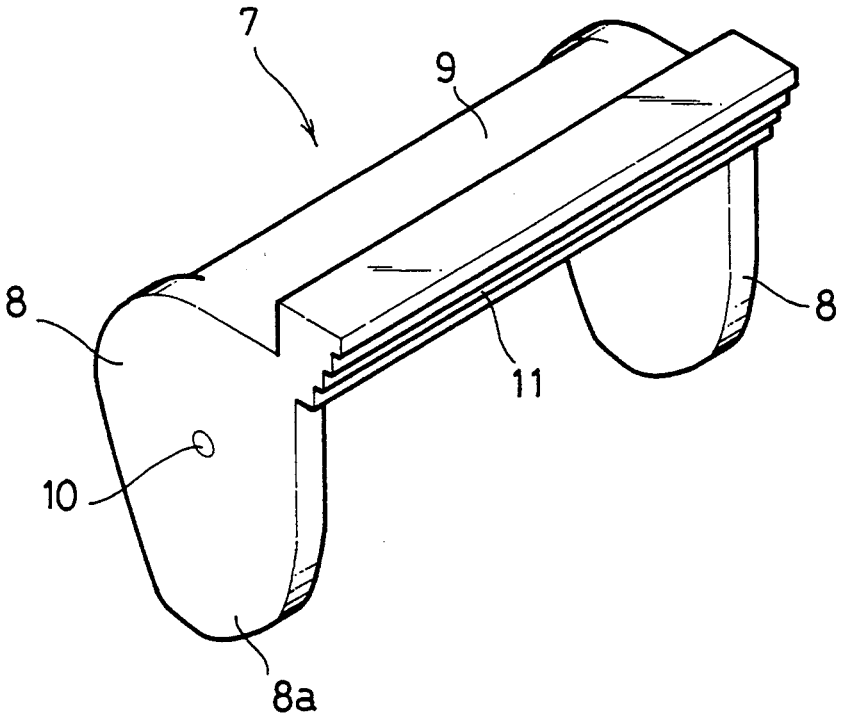
FIG. 4 is a perspective view of a cam.

A cam 7 is mounted on the cam shaft 6. The cam 7 comprises two cam plates 8 respectively contained in the slits 4, and a connecting member 9 for connecting the cam plates 8, as shown in FIGS. 2 to 4. Each of the cam plates 8 has a shape in which a projection 8a is formed on the side opposite to the connecting member 9 with respect to a hole 10 through which the cam shaft 6 is passed, as shown in FIG. 3. The connecting member 9 has a handle portion 11 in which a stepped portion having a plurality of steps is formed for easy touch of finger tips.

The female connector housing B also has a plurality of terminal chambers 12 into each of which a male terminal 14 connected to an electric wire 13 is inserted and locked. The female connector housing B also has a hood 15 which is formed on the side into which the male connector housing is inserted so as to contain the male connector housing A, and an insertion guide wall 16 formed by extending the bottom wall under the hood 15. In the end portion of the insertion guide wall 16 are erected two vertical members 17 which can respectively be inserted into the slits 4 of the male connector housing A. A recess 18 is formed at the end of the upper wall of the hood 15 so as to contain the cam connecting member 9 without interference with the cam 7.

The operation of engaging both connector housings of the electric connector of the present invention configured as described above is described with reference to FIG. 5A to 5C. When the male connector housing A is engaged with the female connector housing B, the male connector housing A is placed on the insertion guide wall 16 of the female connector housing B in such a manner that the cam plates 8 are placed between the vertical members 17 and the recess 18 in the state where the projections 8a face the insertion guide wall 16, as shown in FIG. 5A.

Figure 5A:
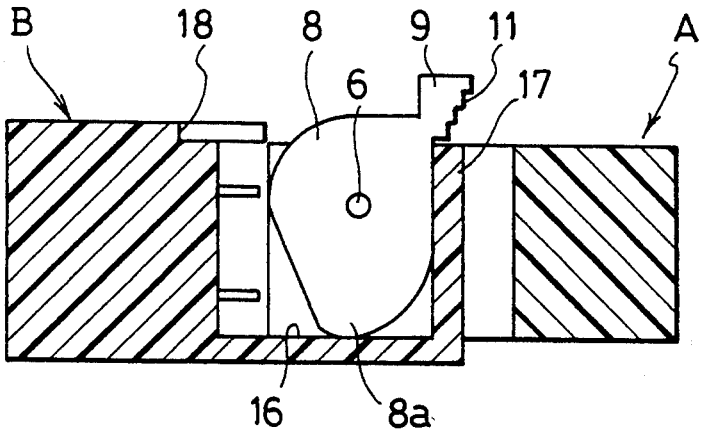
FIGS. 5A, 5B and 5C are drawings illustrating the operation of engaging the connector housings of the electric connector shown in FIG. 1.
Figure 5B:
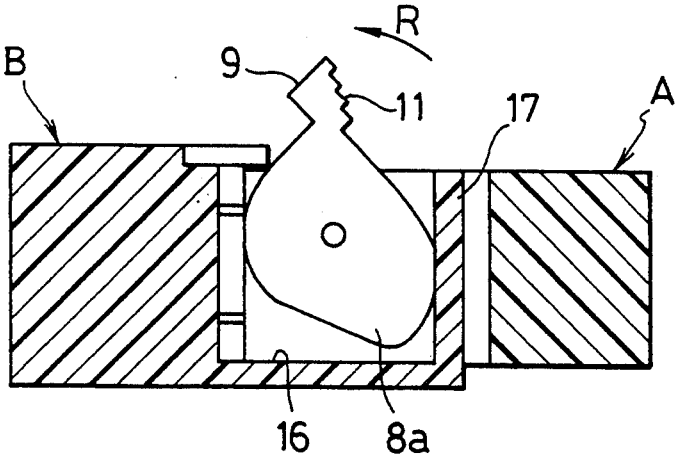
Figure 5C:
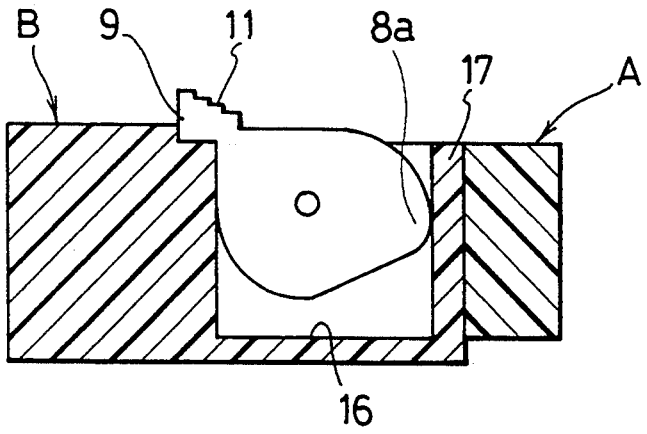

When the cam 7 is rotated in the direction of an arrow R by the finger tips touching the handle portion 11 of the connector member 9, as shown in FIG. 5B, the projections 8*a* of the cam plates 8 respectively push the vertical members 7, and the male connector housing A is thus forced into the female connector housing B by the reaction against the pressure of the cam plates 8. When the handle 11 is rotated until the connecting member 9 abuts on the recess 18 of the female connector housing B, as shown in FIG. 5C, the male connector housing A is completely inserted into the female connector housing B. As a result, electrical contact is secured between the male connector housing A and the female connector housing B. Since a portion projecting from the surfaces of both connector housings is very small, there is no danger of damaging the connecting member 9 or rotating both connector housings to separate them from each other even if the connecting member 9 strikes on a substance.

When the male connector housing A is separated from the female connector housing B, the connecting member 9 may be rotated in the reverse direction from the state shown in FIG. 5C to the state shown in FIG. 5A.

Figure 6A:
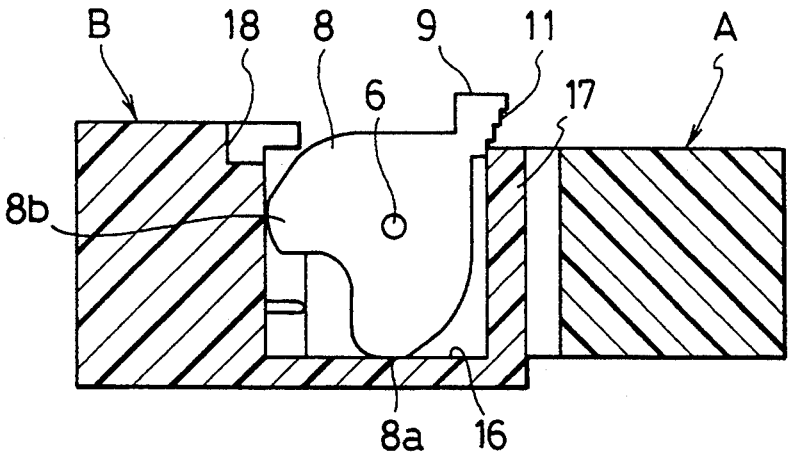
FIGS. 6A, 6B and 6C are drawings illustrating the operation of engaging connector housings of an electric connector in accordance with a second embodiment of the present invention.
Figure 6B:
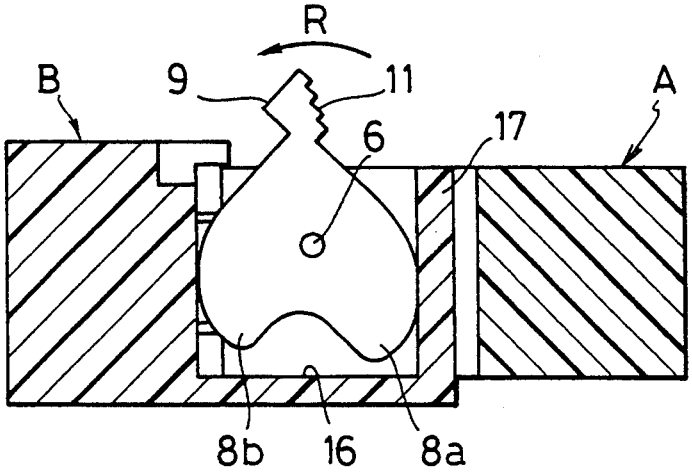
Figure 6C:
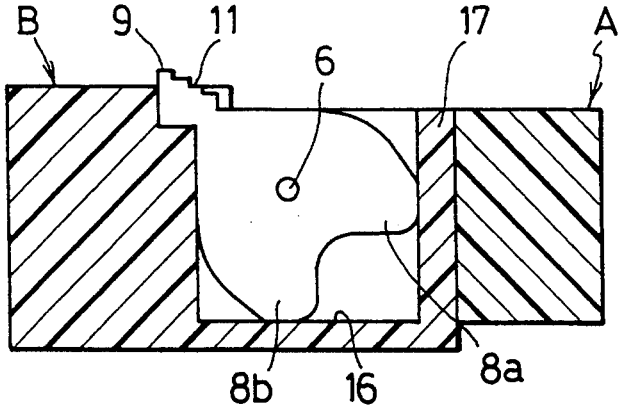

Although the above embodiment uses the cam plates each having one projection 8*a*, cam plates each having two projections 8*a* and 8*b* may be used, as in the second embodiment shown In FIGS. 6A to 6C. The two projections 8*a* and 8*b* are formed to be substantially symmetrical with respect to the axis connecting the cam shaft 6 and the handle portion 11.

In the second embodiment, when the male connector housing A is engaged with the female connector housing B, the male connector housing A is placed on the insertion guide wall 16 of the female connector housing B so that the cam plates 8 enter between the vertical members 17 and the recess 18 in the state where the projections 8*a* face the insertion guide wall 16, as shown in FIG. 6A. When the cam 7 is rotated in the direction of arrow R by the finger tips touching the handle portion 11 of the connecting member 9, as shown in FIG. 6B, the projections 8*a* of the cam plates 8 respectively push the vertical members 17, and the male connector housing A is inserted into the female connector housing B by the reaction against the pressure of the cam plates 8. When the handle 11 is then rotated until the connecting member 9 abuts on the recess 18 of the female connector housing B, as shown in FIG. 6C, the male connector housing A is completely inserted into the female connector housing B.

When the both connector housings A and B are separated from each other, the connecting member 9 is rotated in the direction opposite to the direction of the arrow R. The projections 8*b* of the cam plates 8 respectively push the end surface of the female connector housing B, and the male connector housing A is pushed out by the reaction against the pressure of the cam plates 8.

The electric connector of the present invention has the following effects:

(1) Both connector housings can reliably be engaged by the simple operation of rotating the cam of the male connector housing placed on the insertion guide wall of the female connector housing.

(2) After both connector housings are engaged, even if a substance strikes on the cam, the male connector housing is not separated from the female connector housing because the connecting member of the cam does not project from the female connector housing.

What is claimed is:

1. An electric connector comprising:

a male connector housing comprising a plurality of slits formed so as to be substantially parallel with the engagement direction, a cam shaft crossing said slits and laterally passing through said male connector housing, and a plurality of cam plates supported by said cam shaft so as to be respectively rotatable in said slits, said plurality of cam plates being connected by a lateral connecting member having a handle portion and being formed integrally therewith; and a female connector housing comprising bottom walls and an insertion guide wall extending from one of the bottom walls toward a side receiving said male connector housing, and a plurality of vertical members erected at positions at an edge of said insertion guide wall corresponding to said plurality of slits of said male connector housing; wherein when said vertical members are respectively inserted into said slits, and when said cam plates are rotated through a predetermined angle, said male connector housing is moved to be inserted into said female connector housing due to the pressure of said cam plates on said vertical members.

2. An electric connector according to claim 1, wherein each of said cam plates has a projection on a side thereof opposite to said handle portion with respect to said cam shaft.

3. An electric connector according to claim 1, further comprising a recess provided on an insertion side end of an upper wall of said female connector housing so as to contain the handle portion therein.

4. An electric connector according to claim 1, further comprising a stepped portion having a plurality of steps and formed in said handle portion.

5. An electric connector according to claim 1, wherein each of said cam plates has two projections on a side thereof opposite to said handle portion with respect to said cam shaft.

6. An electric connector according to claim 5, wherein said two projections of each of said cam plates are formed to be substantially symmetrical with respect to an axis connecting said handle portion and said cam shaft.

7. An electric connector according to claim 6, wherein when said cam is rotated in the direction of insertion of said male connector housing, a first projection pushes each of said vertical members, and when said cam is rotated in the opposite direction, a second projection pushes an end surface of said female connector housing.

* * * * *